US005689156A

United States Patent [19]

Derra et al.

[11] Patent Number: 5,689,156

[45] Date of Patent: Nov. 18, 1997

[54] CIRCUIT ARRANGEMENT FOR DETECTING THE AMOUNT OF DEPOSITED ELECTRODE MATERIAL ON THE WALL OF A LAMP VESSEL

[75] Inventors: Günther H. Derra, Aachen; Hanns E. Fischer; Hans G. Ganser, both of Stolberg, all of Germany; Holger Mönch, Vaals, Netherlands

[73] Assignee: U.S. Philips Corporation, New York, N.Y.

[21] Appl. No.: 583,687

[22] Filed: Jan. 5, 1996

[30] Foreign Application Priority Data

Jan. 9, 1995 [EP] European Pat. Off. ..... 95200030.5

[51] Int. Cl.[6] ..... H05B 37/00

[52] U.S. Cl. ..... 315/225; 315/119; 315/120

[58] Field of Search ..... 315/151, 129, 315/225, 291, 307, 119, 120

[56] References Cited

U.S. PATENT DOCUMENTS 3,683,226 8/1972 Witting ..... 313/109

5,109,181 4/1992 Fischer et al. ..... 313/571

*Primary Examiner*—Robert Pascal

*Assistant Examiner*—David Vu

*Attorney, Agent, or Firm*—Walter M. Egbert

[57] ABSTRACT

The invention relates to a measuring circuit for detecting the amount of deposited electrode material on the wall of a lamp vessel of a discharge lamp by measuring the power of infrared radiation within a specific wavelength range, comprising a detector for generating an electrical signal constituting a measure for the power of the infrared light in said specific wave length range. According to the invention the measuring is done in a time lapse starting after a predetermined time interval following the extinguishing of the discharge lamp. An increased accuracy of the measurement is thereby realized.

18 Claims, 3 Drawing Sheets

CIRCUIT ARRANGEMENT FOR DETECTING THE AMOUNT OF DEPOSITED ELECTRODE MATERIAL ON THE WALL OF A LAMP VESSEL

BACKGROUND OF THE INVENTION

The invention relates to a measuring circuit for detecting the amount of deposited electrode material on the wall of a lamp vessel of a discharge lamp by measuring the power of infrared radiation radiated by the discharge lamp within a specific wavelength range, comprising a detector for generating an electrical signal constituting a measure for the power of the infrared light in said specific wavelength range. The invention also relates to a lighting arrangement comprising a discharge lamp, to a method for detecting the deposition of electrode material on the wall of a lamp vessel of a discharge lamp and to a circuit arrangement for operating a discharge lamp.

In general a discharge lamp (further also indicated as lamp) is equipped with electrodes between which the discharge is maintained during operation of the lamp. During lamp operation, however, electrode material is removed from the electrodes and deposited on the wall of the lamp vessel. The electrodes of many discharge lamps for instance comprise tungsten as an emitter material so that during lamp life an increasing amount of tungsten is deposited on the wall of the lamp. This deposition of electrode material not only decreases the light output of the lamp but also leads to an increasing amount of absorption of the radiation coming from the plasma by the deposited electrode material. This absorption can lead to an increase in temperature of the lamp during operation and, depending on the type of lamp, eventually there is the risk that the lamp will explode. This problem exists more in particular for high pressure mercury lamps with a halogen transport cycle as described in DP 3813421. In case the cyclic process involving the halogen is disturbed, an accelerated deposition of electrode material takes place that can relatively easily lead to explosion of the lamp.

It is for instance possible to measure the amount of deposited electrode material by measuring the amount of infrared light within a certain wavelength range radiated by the lamp while the lamp is in stationary operation. The amount of infrared light (mainly generated in the plasma) decreases in case the amount of deposited electrode material increases because it is partly shielded by the deposited electrode material. A disadvantage of this method is that it is relatively inaccurate. This inaccuracy is in part due to the relatively large spread in the output of infrared fight of new lamps.

SUMMARY OF THE INVENTION

It is an object of the present invention to provide a simple and cheap measuring circuit that allows the amount of deposited electrode material to be measured relatively accurately and to provide a circuit arrangement for operating a discharge lamp incorporating such a measuring circuit. It is also an object of the present invention to provide a lighting arrangement comprising such a measuring circuit and to provide a simple and accurate method for measuring the deposited amount of electrode material.

A measuring circuit as described in the opening paragraph is therefore according to the invention characterized in that the measuring circuit is equipped with means I for detecting the extinguishing of the discharge lamp and means II coupled with means I and with the detector for registering the power of the infrared radiation in a time lapse starting after a predetermined time interval following the extinguishing of the lamp.

After the predertermined time interval, that is chosen in dependency of the type and dimensions of the discharge lamp, the electrodes of the lamp have cooled down to a temperature that is approximately equal to the temperature of the lamp vessel and the electrode material deposited thereon. Since no discharge is present in the lamp vessel and the electrodes have a surface area that is oily a fraction of the surface area of the lamp vessel, the major part of the infrared radiation radiated by the discharge lamp, after extinguishing and after the predetermined time interval has lapsed, is generated by the electrode material deposited on the wall of the lamp vessel. Unlike a measurement done while the lamp is in stationary operation, a measurement done a predetermined time interval after the extinguishing of the lamp therefore constitutes a relatively accurate measurement of the amount of electrode material deposited on the wall of the lamp vessel.

The specific wavelength range of the infrared radiation is chosen so that within this range the contribution of the lamp vessel to the total intensity of the infrared radiation is negligible. For a quartz lamp vessel, for instance, this is true if the specific wavelength range is chosen below 3 μm. In case of a lamp vessel manufactured from aluminium oxide the specific wave length needs to be chosen below 7 μm. To make sure that only infrared radiation within the specific wavelength is measured it can be desirable to incorporate an optical filter in the detector.

It has been found that satisfactory results could be achieved in case the detector comprises a silicium photodiode or a germanium photodiode.

The measured value of the power of the infrared radiation may be stored in a memory and for instance be displayed or used to check whether it is still safe to use the lamp. Similarly means II can be coupled with means for generating an audible or visual signal in case the measurement shows the amount of deposited electrode material to be larger than a predetermined amount. The user of the discharge lamp is warned automatically in the latter case that the lamp needs to be replaced.

It is desirable to incorporate a measuring circuit according to the invention in a circuit arrangement for operating a discharge lamp. The measuring circuit enables the user of the lamp to monitor the deposition process very closely and to replace the lamp in time. It is also possible to incorporate a means III in the circuit arrangement for rendering the circuit arrangement inoperable in case the measurement shows the amount of deposited electrode material to be larger than a predetermined amount. The predetermined amount corresponds to the maximum quantity of deposited electrode material allowing a safe operation of the lamp. In this way the user of the circuit arrangement is automatically protected against the use of a lamp having such a large quantity of electrode material deposited on the wall of its lamp vessel that a certain risk of explosion exists in case of a further use of the lamp.

In applications wherein the discharge lamp is used in a lighting arrangement in combination with a reflector pervious to infrared light it is possible to place the reflector between the discharge lamp and the detector. In this way the detector does not interfere with the visible light radiated by the lamp. Such a lighting arrangement is very suitable for use for instance in a projection television.

Similarly a method according to the invention is characterized in that the power of infrared radiation within a specific wavelength range is measured while no discharge is present in the lamp and after the lamp has been heated to an elevated temperature. This heating of the lamp to an elevated temperature can for instance be done in an oven but also by operating the lamp for a while after which the measuring is done in a time lapse starting after a predetermined time interval following the extinguishing of the lamp.

BRIEF DESCRIPTION OF THE DRAWINGS

An embodiment of the invention will be further explained with reference to a drawing.

In the drawing.

DESCRIPTION OF THE PREFERRED EMBODIMENTS

Figure 1:
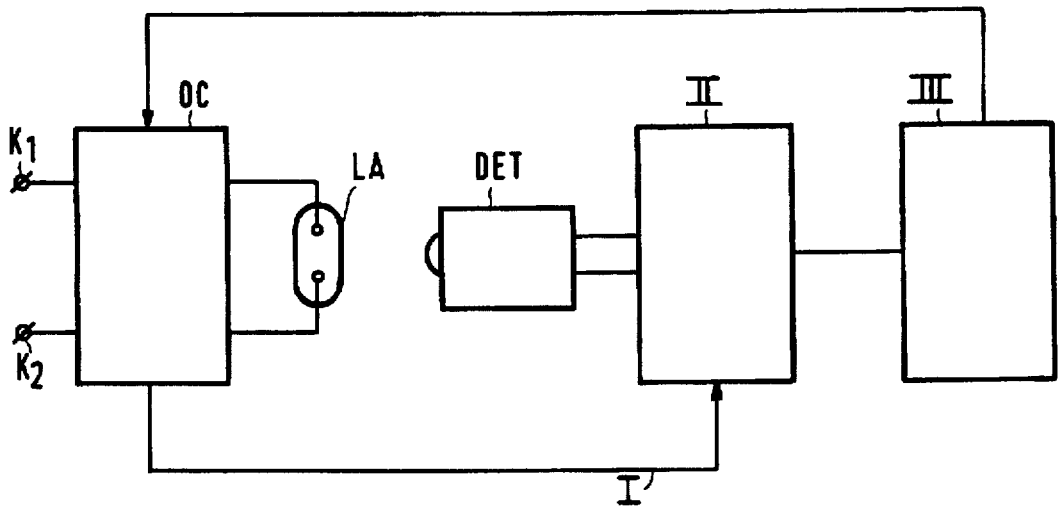
FIG. 1 shows an embodiment of a circuit arrangement comprising a measuring circuit according the invention.

In FIG. 1, K1 and K2 are terminals for connection to a supply voltage source. OC is a circuit for generating from a supply voltage provided by the supply voltage source a current through a discharge lamp. A discharge lamp La is coupled to first and second output terminals of circuit OC. DET is a detector for generating an electrical signal constituting a measure for the power of the infrared light in a specific wavelength range. Output terminals of the detector DET are coupled with first and second input terminals respectively of means II for registering the power of the infrared radiation in a time lapse starting after a predetermined time interval following the extinguishing of the discharge lamp. A third output terminal of circuit OC is coupled to a third input terminal of means II. This latter coupling constitutes in this embodiment means I for detecting the extinguishing of the discharge lamp. The detector DET, means I and means II together form a measuring circuit for measuring the amount of deposited electrode material on the wall of the lamp vessel of a discharge lamp operated by means of the circuit OC. An output terminal of means II is connected to an input terminal of means III for rendering the circuit OC and thereby the circuit arrangement inoperable in case the measurement shows the amount of deposited electrode material to be larger than a predetermined amount. An output terminal of means III is coupled to an input terminal of circuit OC.

The operation of the circuit arrangement shown in FIG. 1 is as follows.

When terminals K1 and K2 are connected to the poles of a voltage supply source and the circuit OC is in operation, it generates a lamp current through the discharge lamp La. When the discharge lamp La is extinguished by stopping the operation of circuit OC, means H are activated via the third output terminal of circuit OC and means I. After a predetermined time interval, means H activate the detector DET and the detector generates a signal constituting a measure for the amount of power of the infrared radiation within a certain wavelength range, radiated by the lamp. This signal is registered by means H. If the signal shows that the amount of electrode material deposited on the wall of the lamp vessel is larger than a predetermined amount, the means HI are activated via the output of the means H and the circuit OC is rendered inoperable. This means that it is impossible to operate the discharge lamp any further and that the discharge lamp needs to be replaced before further lamp operation is possible. The output terminal of means H can also be connected to means for generating an audible or visual signal in case the measurement shows the amount of deposited electrode material to be larger than a predetermined mount. Such means are, however, not shown in FIG. 1. By means of circuitry also not shown in FIG. 1, the replacement of the discharge lamp La renders the circuit OC operative again, which means that further lamp operation is possible again.

Figure 2:
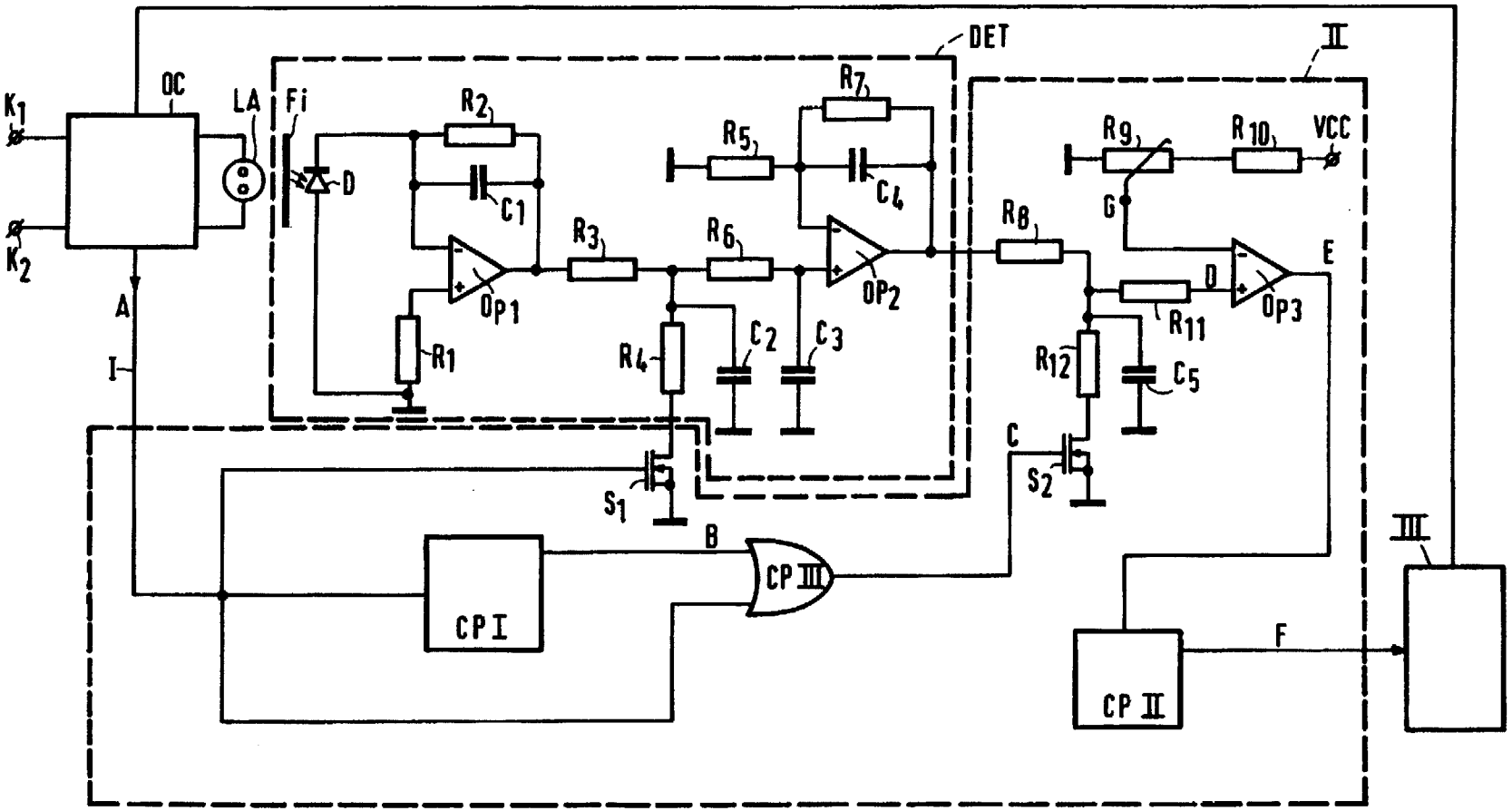
FIG. 2 shows the embodiment of FIG. 1 in more detail.

In FIG. 2 both the construction of the means H as well as the construction of the detector DET is shown in more detail.

The detector DET is constituted by photodiode D, optical filter Fi, operational amplifiers OP1 and OP2, resistors R1–R7 and capacitors C1–C4.

Means II is constituted by circuit parts CPI, CPH and CPIII, switching elements S1 and S2, resistors R8–R12, operational amplifier OP3 and capacitor C5.

Photodiode D can be e.g. of the silicium or the germanium type. An optical filter Fi is placed between the photodiode D and the discharge lamp. The optical filter Fi determines the specific wavelength range within which the infrared radiation is measured. A series arrangement of photodiode D and resistor R1 is connected between the input terminals of operational amplifier OP1. The output terminal of operational amplifier OP1 is connected with an inverting input of operational amplifier OP1 by means of a parallel arrangement of a resistor R2 and a capacitor C1. The output terminal of operational amplifier OP1 is connected to ground potential by means of a series arrangement of resistor R3, resistor R4 and switching element S1. The series arrangement of resistor R4 and switching element S1 is shunted by capacitor C2. A common terminal of resistors R3 and R4 is connected to a non-inverting input of operational amplifier OP2 by means of resistor R6. The non-inverting input of operational amplifier OP2 is also connected to ground potential by means of capacitor C3. An inverting input of operational amplifier OF2 is connected to ground potenmtial by means of resistor R5 and to an output terminal of operational amplifier OP2 by means of a parallel arrangement of capacitor C4 and resistor R7. The output terminal of operational amplifier OP2 is connected to ground potential by means of a series arrangement of resistor R8, resistor R12 and switching element S2. The series arrangement of resistor R12 and switching element S2 is shunted by capacitor C5. A common terminal of resistor R8 and resistor R12 is connected to a non-inverting input of operational amplifier OP3. An inverting input of operational amplifier OP3 is connected to an output terminal of a reference voltage source consisting of a series arrangement of resistors R9 and R10, of which R9 is a potentiometer, connected between a supply voltage terminal Vee and ground potential. An output of operational amplifier OP3 is connected to an input of circuit part CPII, being a bistable multivibrator. An output of circuit part CPII is connected to an input of means III.

The connection constituting means I is connected with between the third output terminal of circuit OC and an input terminal of circuit part CPI, being a monostable multivibrator. The third output of circuit OC is also connected to a control electrode of switching element S1 and to a first input of circuit part CPIII, being an orgate. An output of circuit part CPI is connected to a second input of circuit part CIII.

An output of circuit part CPIII is connected to a control electrode of switching element S2.

The operation of the circuit arrangement shown in FIG. 2, more in particular of the detector and the means II is as follows.

During lamp operation a digital signal A present at the third output of circuit OC is "high". As a result, the output of circuit part CPI is "low", and the output of circuit pan CPIII is "high", so that both the switching elements S1 and S2 are conductive. Because of the switching elements being conductive, both outputs of both operational amplifiers are to a certain extent shortcircuited to ground potential. In case the stationary operation of the discharge lamp La is finished by stopping the operation of circuit OC, the signal A changes from "high" to "low". This change in signal A renders switching element S1 non-conductive. The change in signal A also causes the output of circuit pan CPI (signal B) to become "high" during a time lapse starting a predetermined time after signal A became "low". After the time lapse the output of circuit pan CPI changes back to "low" again. During the time lapse the output of circuit pan CPHI (signal C) is "low", so that switching element S2 is rendered non-conductive. Since during the time lapse both switching elements are non-conductive, a signal (signal D) constituting a measure for the power of the infrared light that after being filtered by the optical optical filter Fi strikes the photodiode is present at the noninverting input of operational amplifier OP3. This signal is compared with a reference signal G generated by the reference voltage source constituted by resistors R9 and R10. Signal G is chosen so as to correspond to a predetermined amount of infrared power. This predetermined amount corresponds to the maximum quantity of deposited electrode material allowing a safe operation of the lamp. In case after the predetermined time interval, at least at the begin of the time lapse, the signal D is larger than the reference signal G, the output (signal E) of operational amplifier OP3 changes from "low" to "high" (during a certain time interval). This situation corresponds with an amount of deposited electrode material on the wall of the lamp vessel that renders further operation of the lamp unsafe. As a result of the change of the output of operational amplifier OP3 from "low" to "high", the output of circuit pan CPII (signal F) changes from "low" to "high". This change in signal F is used to activate means HI for rendering the circuit arrangement inoperable. In case, however, after the predetermined time interval, at least at the begin of the time lapse, the signal D is smaller than the reference signal G, the output (signal E) of operational amplifier OP3 does not change from "low" to "high". As a result signal F does not change either so that means HI are not activated. This latter situation corresponds with an amount of deposited electrode material on the wall of the lamp vessel lower than the amount beyond which further operation of the lamp becomes unsafe.

Figure 3:
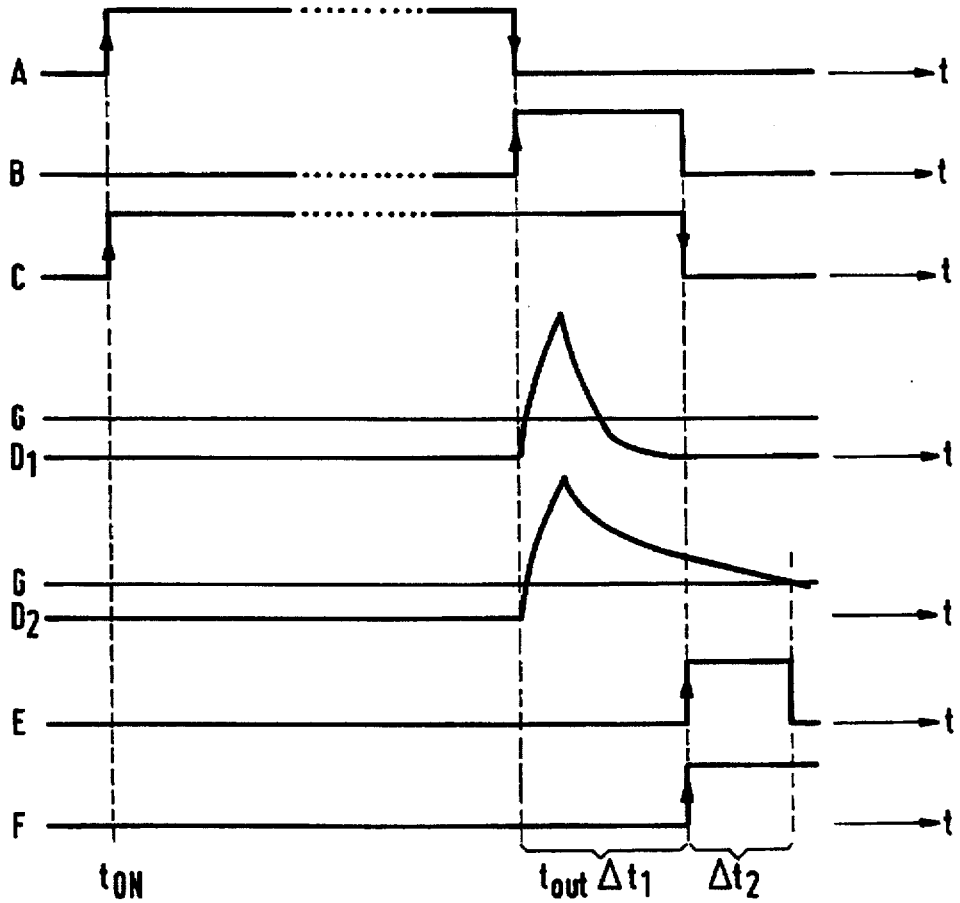
FIG. 3 shows the shape of signals present at different terminals of the embodiment shown in FIG. 2 as a function of time.

In FIG. 3 the time dependency of signals A–G as defined in the description of FIG. 2 is shown. $t_{on}$ is the moment in time at which the operation of the lamp is started. $t_{out}$ is the moment in time at which the lamp is extinguished by stopping the operation of circuit OC. $\Delta t_1$ is the predetermined time interval, starting with the extinguishing of the lamp. $\Delta t_2$ is the time lapse starting at the end of the predetermined time interval. Signal D1 corresponds to a relatively low amount of deposited electrode material on the wall of the lamp vessel. Consequently signal D 1 is lower than the reference signal G at the beginning of the time lapse $\Delta t_2$. Signal D2 corresponds to a relatively large amount of deposited electrode material on the wall of the lamp vessel. As a result signal D2 is higher than the reference signal G at the beginning of the time lapse $\Delta t_2$. The shape of signals E and F are shown for this latter situation.

Figure 4:
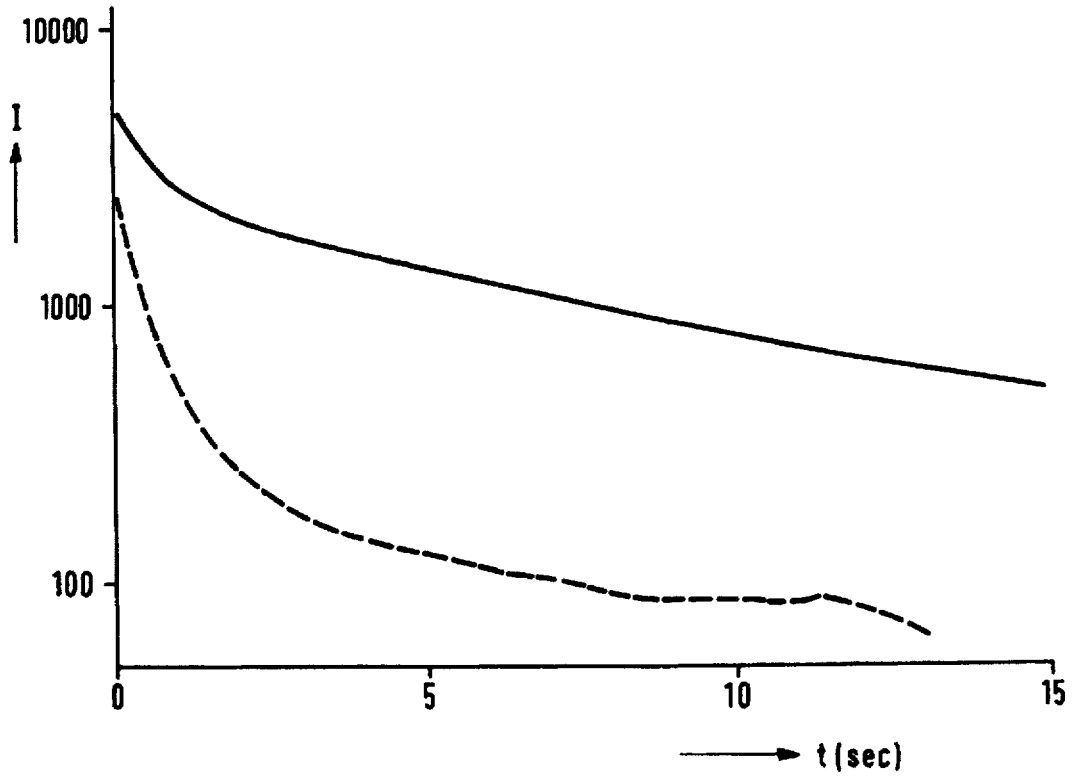
FIG. 4 shows the relative intensity of infrared radiation as measured by a measuring circuit according to the invention for both an unused discharge lamp and a used discharge lamp.

In the graph shown in FIG. 4, the relative intensity of the infrared radiation radiated by a high pressure mercury discharge lamp is plotted using a logarithmic scale along the vertical axis. The time in seconds lapsed after the extinguishing of the lamp is plotted along the horizontal axis. The solid curve represents a lamp having a certain amount of electrode material deposited on the wall of the lamp vessel, while the dotted curve represents a new lamp having virtually no electrode material deposited on the wall of the lamp vessel. As can be seen from FIG. 4 the difference in the amount of infrared radiation between the two lamps is relatively large between approximately 4 and 15 seconds after the extinguishing of the lamp, so that measuring the amount of deposition during this time lapse yields relatively accurate results. When the power of the infrared radiation within the same wavelength range was measured for both lamps while the lamps were in stationary operation, the infrared power radiated by the lamp with deposition of electrode material on the wall of the lamp vessel was only 15 % lower than that radiated by the new lamp. The lamps both were high pressure mercury lamps with a halogen transport cycle as described in DP 3813421. Both had a nominal power of approximately 100 Watt. The power of the infrared radiation was measured using a detector comprising a silicium photodiode and an optical filter with a cut off wavelength at 900 nm. Since the silicium photodiode has a sensitivity limit at 1100 nm, the specific wavelength range within which the intensity of the infrared radiation was measured was 900 nm–1100 nm.

We claim:

1. Method for measuring the mount of deposited electrode material on the wall of a lamp vessel of a discharge lamp, comprising heating the discharge lamp to an elevated temperature and measuring the power of infrared radiation radiated by the discharge lamp within a specific wavelength range, characterized in that the measuring is done while no discharge is present in the discharge lamp.

2. Method according to claim 1 wherein the heating of the discharge lamp is accomplished by operating the discharge lamp and the measuring is done in a time lapse starting after a predetermined time interval following the extinguishing of the discharge lamp.

3. Measuring circuit for measuring the amount of deposited electrode material on the wall of a lamp vessel of a discharge lamp by measuring the power of infrared radiation radiated by the discharge lamp within a specific wavelength range, comprising a detector for generating an electrical signal constituting a measure for the power of the infrared light in said specific wave length range, characterized in that the measuring circuit is equipped with a means for detecting the extinguishing of the discharge lamp and a means coupled with said means and for detecting with the detector for registering the power of the infrared radiation in a time lapse starting after a predetermined time interval following the extinguishing of the discharge lamp.

4. Measuring circuit according to claim 3, wherein the detector comprises a silicium photodiode or a germanium photodiode.

5. Measuring circuit according to claim 4, wherein said means for registering are coupled with means for generating an audible or visual signal in case the measurement shows the amount of deposited electrode material to be larger than a predetermined amount.

6. Measuring circuit according to claim 4, comprising an optical filter.

7. Measuring circuit according to claim 4, wherein said means for registering comprise a memory.

8. Measuring circuit according to claim 7, comprising an optical filter.

9. Measuring circuit according to claim, wherein said means for registering are coupled with means for generating an audible or visual signal in ease the measurement shows the amount of deposited electrode material to be larger than a predetermined amount.

10. Measuring circuit according to claim 9, comprising an optical filter.

11. Measuring circuit according to claim 9, comprising an optical filter.

12. Circuit arrangement for operating the discharge lamp incorporating a circuit OC for generating a lamp current out of a supply voltage and the measuring circuit according to claim 3.

13. Circuit arrangement according to claim 12 comprising means for rendering the circuit arrangement inoperable in case the measurement shows the amount of deposited electrode material to be larger than a predetermined amount.

14. Lighting arrangement including the discharge lamp, the measuring circuit as claimed in claim 3 and a reflector pervious to infrared light wherein the reflector is placed between the discharge lamp and the detector.

15. Measuring circuit according to claim 3, wherein said means for registering are coupled with means for generating an audible or visual signal in case the measurement shows the amount of deposited electrode material to be larger than a predetermined amount.

16. Measuring circuit according to claim 3, wherein said means for registering comprise a memory.

17. Measuring circuit according to claim 16, wherein said means for registering are coupled with means for generating an audible or visual signal in case the measurement shows the amount of deposited electrode material to be larger than a predetermined amount.

18. Measuring circuit according to claim 3, comprising an optical filter.

* * * * *